US007828537B2

(12) United States Patent
Parvov et al.

(10) Patent No.: US 7,828,537 B2
(45) Date of Patent: Nov. 9, 2010

(54) ROTARY ENGINE WITH INLET AND OUTLET VALVES

(76) Inventors: Totyo Nedyalkov Parvov, 6530 W. Irving Park Rd., Apt. 305, Chicago, IL (US) 60634; Nedyalko Parvov Nedyalkov, 6530 W. Irving Park Rd., Apt. 305, Chicago, IL (US) 60634

( * ) Notice: Subject to any disclaimer, the term of this patent is extended or adjusted under 35 U.S.C. 154(b) by 538 days.

(21) Appl. No.: 11/904,430

(22) Filed: Sep. 28, 2007

(65) Prior Publication Data

US 2009/0084099 A1 Apr. 2, 2009

(51) Int. Cl.
*F01C 1/00* (2006.01)
*F03C 2/00* (2006.01)

(52) U.S. Cl. ..... 418/225; 418/226; 123/241

(58) Field of Classification Search ..... 418/221, 418/225–227, 259, 178, 179; 123/241
See application file for complete search history.

(56) References Cited

U.S. PATENT DOCUMENTS 1,214,981 A * 2/1917 Wikander ..... 418/225
2,657,638 A * 11/1953 English ..... 418/225
5,039,290 A * 8/1991 Nardi ..... 418/225
6,250,279 B1 * 6/2001 Zack ..... 418/225

FOREIGN PATENT DOCUMENTS

WO WO 8100133 A1 * 1/1981 ..... 418/225

* cited by examiner

*Primary Examiner*—Theresa Trieu

(57) ABSTRACT

A rotary engine is disclosed, which may include a housing having at least one inlet valve and at least one outlet valve. The rotary engine may also include at least one chamber coupled to the housing and to the at least one inlet valve, a generally cylindrical driveshaft extending through the housing, and a rotor that is rotationally mounted in the housing on the driveshaft. The rotor may include a plurality of recessed portions situated radially along the peripheral surface of the rotor. The plurality of recessed portions may be used for receiving a plurality of spheres, for example. The plurality of spheres may be rotationally engaged between an inner surface of the housing and the peripheral surface of the rotor. Each of the plurality of spheres may remain in a corresponding one of the plurality of recessed portions while the rotor rotates within the housing.

10 Claims, 2 Drawing Sheets

ROTARY ENGINE WITH INLET AND OUTLET VALVES

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to rotary engines. More specifically, certain embodiments of the invention relate to a rotary engine comprising a rotor with a plurality of recessed portions situated radially along a peripheral surface of the rotor.

BACKGROUND OF THE INVENTION

The first rotary device was invented by Romelli in the late 16th century. Romelli's rotary unit had a circular rotor with mounted four vanes in the rotor. Since then, rotary engines have been developed and have met with some success. However many rotary engines have not been successful commercially and even now such engines are not in wide use. In some of these engines, a close tolerance between the inner wall and the rotor edges had to be maintained or leakage of gases would occur, resulting in poor engine performance. In other engines, due to excessive amount of friction associated with the rotor, the revolutions-per-minute (rpm) characteristics of the engine would worsen, also resulting in poor engine performance.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

Certain aspects of the invention may be found in a rotary engine, which may comprise a housing having at least one inlet valve and at least one outlet valve. The rotary engine may also comprise at least one chamber coupled to the housing and to the at least one inlet valve, a generally cylindrical driveshaft extending through the housing, and a rotor that is rotationally mounted in the housing on the driveshaft. The rotor may comprise a plurality of recessed portions situated radially along the peripheral surface of the rotor. The plurality of recessed portions may be used for receiving a plurality of spheres, for example. The plurality of spheres may be rotationally engaged between an inner surface of the housing and the peripheral surface of the rotor. Each of the plurality of spheres may remain in a corresponding one of the plurality of recessed portions while the rotor rotates within the housing.

The at least one chamber may be removably mounted to the housing, for example via bolts, screws, and/or other similar means. The at least one chamber may be adapted for storing a pressurized substance, which may comprise a gaseous substance and/or a liquid. The at least one inlet valve may be disposed between the housing and the at least one chamber so that the pressurized substance may be released inside the housing, thereby rotationally engaging at least a portion of the plurality of spheres, and thereby causing rotation of the rotor. The at least one chamber may comprise at least one inlet valve for filling up the at least one chamber with the substance. The rotor and the driveshaft may be molded as a single element. The driveshaft may be insulated (or separated) from the housing via a plurality of ball-bearings and/or a plurality of roller-bearings. The plurality of recessed portions may be spaced at equal distances along the peripheral surface of the rotor. The at least one outlet valve may be disposed along a perimeter of the housing. The housing may comprise a servicing knob (or a removable threaded knob). The servicing knob may be threaded onto the housing so that when the servicing knob is removed, the resulting opening in the housing may be used to remove one or more of the plurality of spheres for servicing. In this regard, the diameter of the opening resulting from the removal of the servicing knob may be slightly longer than the diameter of each of the plurality of spheres.

In accordance with an embodiment of the invention, a rotary engine may comprise a housing having at least one inlet valve and a plurality of outlet valves. The plurality of outlet valves may be disposed on the peripheral surface of the housing. At least one chamber may be coupled to the housing and to the at least one inlet valve. The at least one chamber may be adapted for storing a pressurized substance. The rotary engine may also comprise a generally cylindrical driveshaft extending through the housing, and a rotor that is rotationally mounted in the housing and on the driveshaft. The rotor may comprise a plurality of recessed portions situated radially along the peripheral surface of the rotor. The plurality of recessed portions may be used for receiving, for example, a plurality of spheres. The plurality of spheres may be rotationally engaged between an inner surface of the housing and the peripheral surface of the rotor.

Each of the plurality of spheres may remain in a corresponding one of the plurality of recessed portions, while the rotor rotates within the housing. The at least one inlet valve may be disposed between the housing and the at least one chamber so that the pressurized substance may be released inside the housing, thereby rotationally engaging at least a portion of the plurality of spheres, and thereby causing rotation of the rotor. The at least one chamber may be removably mounted to the housing. The substance may comprise a gaseous substance and/or a liquid. The at least one chamber may comprise at least one inlet valve for filling up the chamber with the substance. The rotor and the driveshaft may be molded as a single element. The driveshaft may be insulated from the housing via a plurality of ball-bearings and/or a plurality of roller-bearings. The plurality of recessed portions may be spaced at equal distances along the peripheral surface of the rotor.

In accordance with another embodiment of the invention, a rotary engine may comprise a housing having at least one inlet valve and a plurality of outlet valves. The plurality of outlet valves may be disposed on the peripheral surface of the housing. The rotary engine may also comprise at least one chamber coupled to the housing and to the at least one inlet valve. The at least one chamber may be adapted for storing a pressurized substance. The rotary engine may further comprise a generally cylindrical driveshaft extending through the housing, and a rotor that is rotationally mounted in the housing on the driveshaft. The rotor may comprise a plurality of recessed portions situated radially along the peripheral surface of the rotor. The plurality of recessed portions may be used for receiving a plurality of rolls. The plurality of rolls may be rotationally engaged between an inner surface of the housing and the peripheral surface of the rotor.

Each of the plurality of rolls may remain in a corresponding one of the plurality of recessed portions while the rotor rotates within the housing. The at least one inlet valve may be disposed between the housing and the at least one chamber so that the pressurized substance may be released inside the housing, thereby rotationally engaging at least a portion of the plurality of rolls, and thereby causing rotation of the rotor. The plurality of rolls may comprise a plurality of metal cylinders and/or a plurality of metal shortened cones. The at least one chamber may be removably mounted to the housing. The substance may comprise a gaseous substance and/or a liquid. The rotor and the driveshaft may be molded as a single element. The driveshaft may be insulated from the housing via a plurality of ball-bearings and/or a plurality of roller-bearings. The plurality of recessed portions may be spaced at equal distances along the peripheral surface of the rotor.

Various advantages, aspects and novel features of the present invention, as well as details of an illustrated embodiment thereof, will be more fully understood from the following description and drawings.

DETAILED DESCRIPTION OF THE INVENTION

Figure 1B:
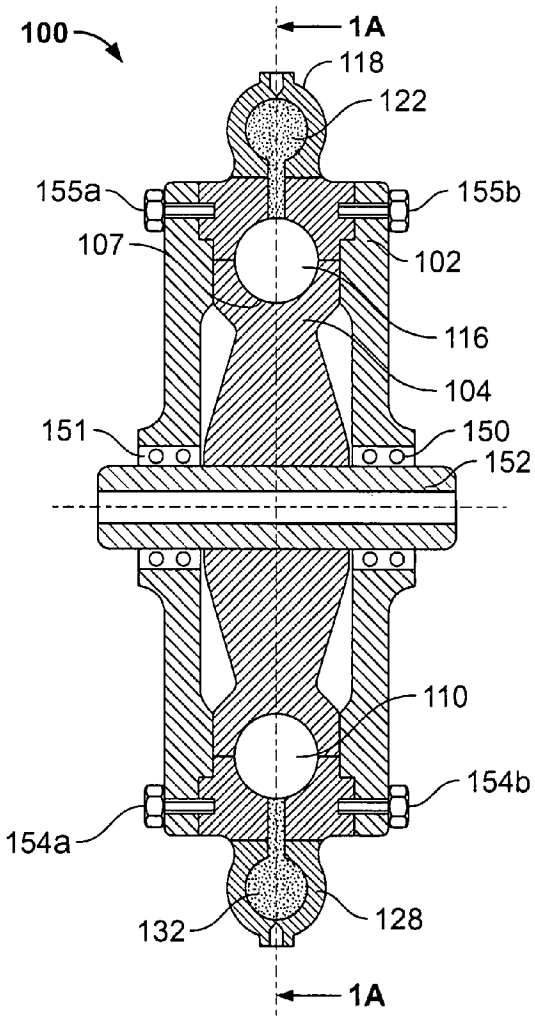
FIG. 1B is a partial cross-sectional front view of the exemplary rotary engine of FIG. 1A, in accordance with an embodiment of the invention.

Certain aspects of the invention may be found in a rotary engine, which may comprise a housing having at least one inlet valve and at least one outlet valve. The rotary engine may also comprise at least one chamber coupled to the housing and to the at least one inlet valve, a generally cylindrical driveshaft extending through the housing, and a rotor that is rotationally mounted in the housing on the driveshaft. The rotor may comprise a plurality of recessed portions situated radially along the peripheral surface of the rotor. The plurality of recessed portions may be used for receiving a plurality of spheres, for example. The plurality of spheres may be rotationally engaged between an inner surface of the housing and the peripheral surface of the rotor. Each of the plurality of spheres may remain in a corresponding one of the plurality of recessed portions while the rotor rotates within the housing.

The at least one chamber may be removably mounted to the housing, for example via bolts, screws, and/or other similar means. The at least one chamber may be adapted for storing a pressurized substance, which may comprise a gaseous substance and/or a liquid. The at least one inlet valve may be disposed between the housing and the at least one chamber so that the pressurized substance may be released inside the housing, thereby rotationally engaging at least a portion of the plurality of spheres, and thereby causing rotation of the rotor. The at least one chamber may comprise at least one inlet valve for filling up the at least one chamber with the substance. The rotor and the driveshaft may be molded as a single element. The driveshaft may be insulated (or separated) from the housing via a plurality of ball-bearings and/or a plurality of roller-bearings. The plurality of recessed portions may be spaced at equal distances along the peripheral surface of the rotor. The at least one outlet valve may be disposed along a perimeter of the housing. The housing may comprise a servicing knob (or a removable threaded knob). The servicing knob may be threaded onto the housing so that when the servicing knob is removed, the resulting opening in the housing may be used to remove one or more of the plurality of spheres for servicing. In this regard, the diameter of the opening resulting from the removal of the servicing knob may be slightly longer than the diameter of each of the plurality of spheres.

In accordance with an embodiment of the invention, a rotary engine may comprise a housing having at least one inlet valve and a plurality of outlet valves. The plurality of outlet valves may be disposed on the peripheral surface of the housing. At least one chamber may be coupled to the housing and to the at least one inlet valve. The at least one chamber may be adapted for storing a pressurized substance. The rotary engine may also comprise a generally cylindrical driveshaft extending through the housing, and a rotor that is rotationally mounted in the housing and on the driveshaft. The rotor may comprise a plurality of recessed portions situated radially along the peripheral surface of the rotor. The plurality of recessed portions may be used for receiving, for example, a plurality of spheres. The plurality of spheres may be rotationally engaged between an inner surface of the housing and the peripheral surface of the rotor. Each of the plurality of spheres may remain in a corresponding one of the plurality of recessed portions, while the rotor rotates within the housing. The at least one inlet valve may be disposed between the housing and the at least one chamber so that the pressurized substance may be released inside the housing, thereby rotationally engaging at least a portion of the plurality of spheres, and thereby causing rotation of the rotor. The at least one chamber may be removably mounted to the housing. The substance may comprise a gaseous substance and/or a liquid. The at least one chamber may comprise at least one inlet valve for filling up the chamber with the substance. The rotor and the driveshaft may be molded as a single element. The driveshaft may be insulated from the housing via a plurality of ball-bearings and/or a plurality of roller-bearings. The plurality of recessed portions may be spaced at equal distances along the peripheral surface of the rotor.

In accordance with another embodiment of the invention, a rotary engine may comprise a housing having at least one inlet valve and a plurality of outlet valves. The plurality of outlet valves may be disposed on the peripheral surface of the housing. The rotary engine may also comprise at least one chamber coupled to the housing and to the at least one inlet valve. The at least one chamber may be adapted for storing a pressurized substance. The rotary engine may further comprise a generally cylindrical driveshaft extending through the housing, and a rotor that is rotationally mounted in the housing on the driveshaft. The rotor may comprise a plurality of recessed portions situated radially along the peripheral surface of the rotor. The plurality of recessed portions may be used for receiving a plurality of rolls. The plurality of rolls may be rotationally engaged between an inner surface of the housing and the peripheral surface of the rotor. Each of the plurality of rolls may remain in a corresponding one of the plurality of recessed portions while the rotor rotates within the housing. The at least one inlet valve may be disposed between the housing and the at least one chamber so that the pressurized substance may be released inside the housing, thereby rotationally engaging at least a portion of the plurality of rolls, and thereby causing rotation of the rotor. The plurality of rolls may comprise a plurality of metal cylinders and/or a plurality of metal shortened cones. The at least one chamber may be removably mounted to the housing. The substance may comprise a gaseous substance and/or a liquid. The rotor and the driveshaft may be molded as a single element. The driveshaft may be insulated from the housing via a plurality of ball-bearings and/or a plurality of roller-bearings. The plurality of recessed portions may be spaced at equal distances along the peripheral surface of the rotor.

Figure 1A:
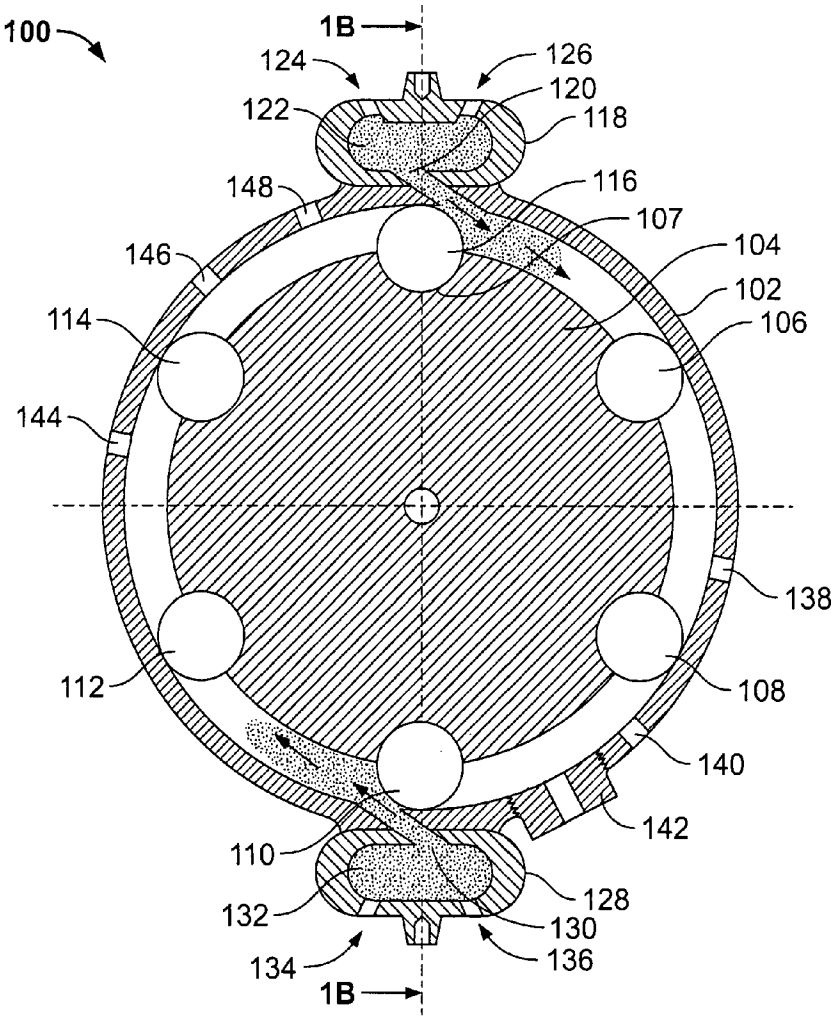
FIG. 1A is a partial cross-sectional side view of an exemplary rotary engine, in accordance with an embodiment of the invention.

FIG. 1A is a partial cross-sectional side view of an exemplary rotary engine, in accordance with an embodiment of the invention. Referring to FIG. 1A, there is illustrated an exemplary rotary engine 100. The rotary engine 100 may comprise a housing 102. The rotary engine 100 may also comprise chambers 118 and 128, and a rotor 104. The housing 102 may comprise inlet valves 120 and 130, and a plurality of outlet valves, such as 138, 140, 144, 146, and 148. The rotor 104 may comprise a plurality of recessed portions, such as recessed portion 107. Each of the recessed portions may be disposed radially along the peripheral surface of the rotor 104, and each of the recessed portions may be used for receiving a sphere, such as spheres 106, . . . , 116.

For example, the recessed portion 107 may appear as an indentation or a "nest" on the surface of the rotor 104, so that a corresponding sphere, such as sphere 116, may sit in the recessed portion 107, or sit inside the "nest" formed by the recessed portion 107. Even though only six spheres are shown in FIG. 1A, the present invention may not be so limited. In this regard, a different number (smaller or larger than six) of spheres, and corresponding recessed portions, may be used with regard to the rotor 104. Furthermore, the spheres 106, . . . , 116, may be made of various sturdy materials, such as plastic, metal or any other type of sturdy material used for similar applications. In other embodiment of the invention, the recessed portions, such as portion 107, may be characterized with a different depth. In this regard, when the corresponding spheres 106, . . . , 116 are nested in the recessed portions, such as recessed portion 107, the resulting space between the peripheral surface of the rotor 104 and the inside wall of the housing 102 may vary as the depth of the recessed portions varies.

Even though FIG. 1A illustrates the use of spheres 106, . . . , 116, the present invention may not be so limited. In another embodiment of the invention, the recessed portions, such as recessed portion 107, disposed radially along the peripheral surface of the rotor 104 may be adapted to receive a plurality of rolls or shortened cones, rather than spheres. In this regard, the rotary engine 100 may comprise a corresponding plurality of rolls, in place of the spheres 106, . . . , 116. The rolls may be rotationally engaged between an inner surface of the housing and the peripheral surface of the rotor. The rolls may comprise, for example, metal cylinders (or cylinders made of another type of sturdy and durable material) and/or shortened metal cones (or cones made of another type of sturdy and durable material).

Even though FIG. 1A illustrates the rotary engine 100 as comprising two chambers 118 and 128, the present invention may not be so limited. In this regard, the rotary engine 100 may comprise a single chamber or more than two chambers. Chambers 118 and 128 may be adapted for storing a pressurized substance 122 and 132. The pressurized substance 122 and 132 may comprise pressurized gas or pressurized liquid. Furthermore, the chambers 118 and 128 may be disposed on top of the engine inlet valves 120 and 130, respectively. In this regard, the pressurized substance from the chambers 118 and 128 may enter the housing 102 and be dispersed between the space formed by the peripheral surface of the rotor 104 and the inner surface of the housing 102. When inside the housing, the pressurized substance may also enter into contact with one or more of the spheres 106, . . . , 116, thereby rotationally engaging the spheres and causing rotation of the rotor 104. Each of the chambers 118 and 128 may further comprise one or more chamber inlet valves, such as chamber inlet valves 124, 126, 134, and 136. The chamber inlet valves 124, 126, 134, and 136 may be used to fill the chambers 118 and 128 with the pressurized substance 122 and 132, respectively.

In one embodiment of the invention, the rotary engine 100 may be used as a part of another engine, or any other process or application, where pressurized gases or fluids are generated during operation. For example, the rotary engine 100 may be used as a part of an internal combustion engine, where pressurized gases generated in the operation of the internal combustion engine, may be delivered via the inlet valves 120 and 130, thereby resulting in rotation of the rotor 104.

In another embodiment of the invention, the housing 102 may comprise a servicing knob 142. The servicing knob 142 may be, for example, threaded onto the housing 102. Furthermore, the diameter of the servicing knob 142 may be slightly larger than the diameter of each of the spheres 106, . . . , 116. In this regard, in instances when the servicing knob 142 is removed, the resulting opening in the housing 102 may be sufficiently big so that one or more of the spheres 106, . . . , 116 may be removed for greasing or servicing the rotor 104 or any of the recessed portions or for any other reason relating to the operation of the rotary engine 100. In yet another embodiment of the invention, the servicing knob 142 may comprise an outlet valve, as it is illustrated in FIG. 1A.

Even though FIG. 1A illustrates that the housing 102 comprises six outlet valves 138, 140, 142 (on top of the servicing knob 142), 144, 146, and 148, the present invention may not be so limited. In this regard, the housing 102 may comprise a different number (smaller or larger than six) of outlet valves. Each of the outlet vales 138, . . . , 148 may be used as exhaust valves, so that the pressurized substance 122 and/or 132 may be drained or exhausted outside of the housing 102.

In operation, the pressurized substance 122 and/or 132 may enter the housing 102 from the chambers 118 and 128 via the inlet valves 120 and 130, respectively, of the rotary engine 100. The pressurized substance may then enter into contact with the peripheral surface of the rotor 104, an inside surface of the housing 102, and a surface of one or more of the spheres 106, . . . , 116. As the substance 122 (and 132) is pressurized, it will push against the surface of the spheres. For example, referring to FIG. 1A, as the pressurized substance 122 and 132 enters the housing, it enters into contact with spheres 106 and 112, respectively. Since all the spheres are "nested" or sitting inside their respective recessed portions, as the pressurized substance "pushes" against the spheres, such as spheres 106 and 112, the pressure force of the substance will engage the spheres, thereby rotationally engaging the rotor 104, causing rotation of the rotor 104 (in the example illustrated in FIG. 1A, the rotor 104 will rotate clockwise). Movement in counter-clockwise direction may also be possible. As the rotor 104 rotates and the pressurized substance 122 and 132 reaches the outlet valves 138, . . . , 142 and 144, . . . , 148, respectively, the pressurized substance 122 and 132 will exhaust and drain out of the housing 104 via one or more of the outlet valves.

FIG. 1B is a partial cross-sectional front view of the exemplary rotary engine of FIG. 1A, in accordance with an embodiment of the invention. Referring to FIG. 1B, the chambers 118 and 128 may be removably mounted to the housing 102. For example, chamber 118 may be removably mounted via mounting means 155*a* and 155*b*. Similarly, chamber 128 may be removably mounted via mounting means 154*a* and 154*b*. Mounting means 154*a*, 154*b*, 155*a*, and 155*b* may comprise bolts, screws, and/or other mounting means, which, if needed, may be removed so that the chambers 118 and 128 may also be removed from the housing for servicing, for example.

In one embodiment of the invention, the rotary engine 100 may also comprise a driveshaft 152. In this regard, the rotor 104 may be mounted on the driveshaft 152. The driveshaft may be used to pass on the rotation from the rotor 104 to other elements or machines outside the housing 102 (not illustrated in FIGS. 1A and 1B). In yet another embodiment of the invention, the rotor 104 and the drive shaft 152 may be molded or manufactured as a single piece. In instances where the rotor 104 and the driveshaft 152 are two separate elements, the driveshaft 152 may be mounted on the rotor via any secure means known in the art.

Referring again to FIG. 1B, the driveshaft 152 may be insulated from the housing 102 via a plurality of ball-bearings, such as 150 and 151. In another embodiment of the invention, the insulating elements 150 and 151 may comprise roller-bearings (e.g., 150' and 151' in FIG. 1C), or any combination thereof.

Certain aspects of the invention may be found in a rotary engine, such as rotary engine 100, which may comprise a housing 102 having at least one inlet valve (120 and 130) and at least one outlet valve (138, . . . , 148). The rotary engine 100 may also comprise at least one chamber (118 and 128) coupled to the housing 102 and to the at least one inlet valve (120 and 130), a generally cylindrical driveshaft 152 extending through the housing, and a rotor 104 that is rotationally mounted in the housing 102 and on the driveshaft 152. The rotor 104 may comprise a plurality of recessed portions (107) situated radially along the peripheral surface of the rotor 104. The plurality of recessed portions 107 may be used for receiving a plurality of spheres (106, . . . , 116), for example. The plurality of spheres (106, . . . , 116) may be rotationally engaged between an inner surface of the housing 102 and the peripheral surface of the rotor 104. Each of the plurality of spheres (106, . . . , 116) may remain in a corresponding one of the plurality of recessed portions 107 while the rotor rotates within the housing 102.

The at least one chamber (118, 128) may be removably mounted to the housing 102, for example via bolts, screws, and/or other similar means (154*a*, 154*b*, 155*a*, 155*b*). The at least one chamber (118, 128) may be adapted for storing a pressurized substance (122, 132), which may comprise a gaseous substance and/or a liquid. The at least one inlet valve (120, 130) may be disposed between the housing 102 and the at least one chamber (118, 128) so that the pressurized substance (122, 132) may be released inside the housing 102, thereby rotationally engaging at least a portion of the plurality of spheres (106, . . . , 116), and thereby causing rotation of the rotor 104. The at least one chamber (118, 128) may comprise at least one inlet valve (124, 126, 134, 136) for filling up the at least one chamber (118, 128) with the substance (122, 132). The rotor 104 and the driveshaft 152 may be molded as a single element. The driveshaft 152 may be insulated (or separated) from the housing 102 via a plurality of ball-bearings and/or a plurality of roller-bearings (150, 151). The plurality of recessed portions 107 may be spaced at equal distances along the peripheral surface of the rotor 104. The at least one outlet valve (138, . . . , 148) may be disposed along a perimeter of the housing 102. The housing 102 may comprise a servicing knob (or a removable threaded knob) 142. The servicing knob 142 may be threaded onto the housing 102 so that when the servicing knob 142 is removed, the resulting opening in the housing 102 may be used to remove one or more of the plurality of spheres (106, . . . , 116) for servicing. In this regard, the diameter of the opening resulting from the removal of the servicing knob 142 may be slightly longer than the diameter of each of the plurality of spheres (106, . . . , 116).

Figure 1C:
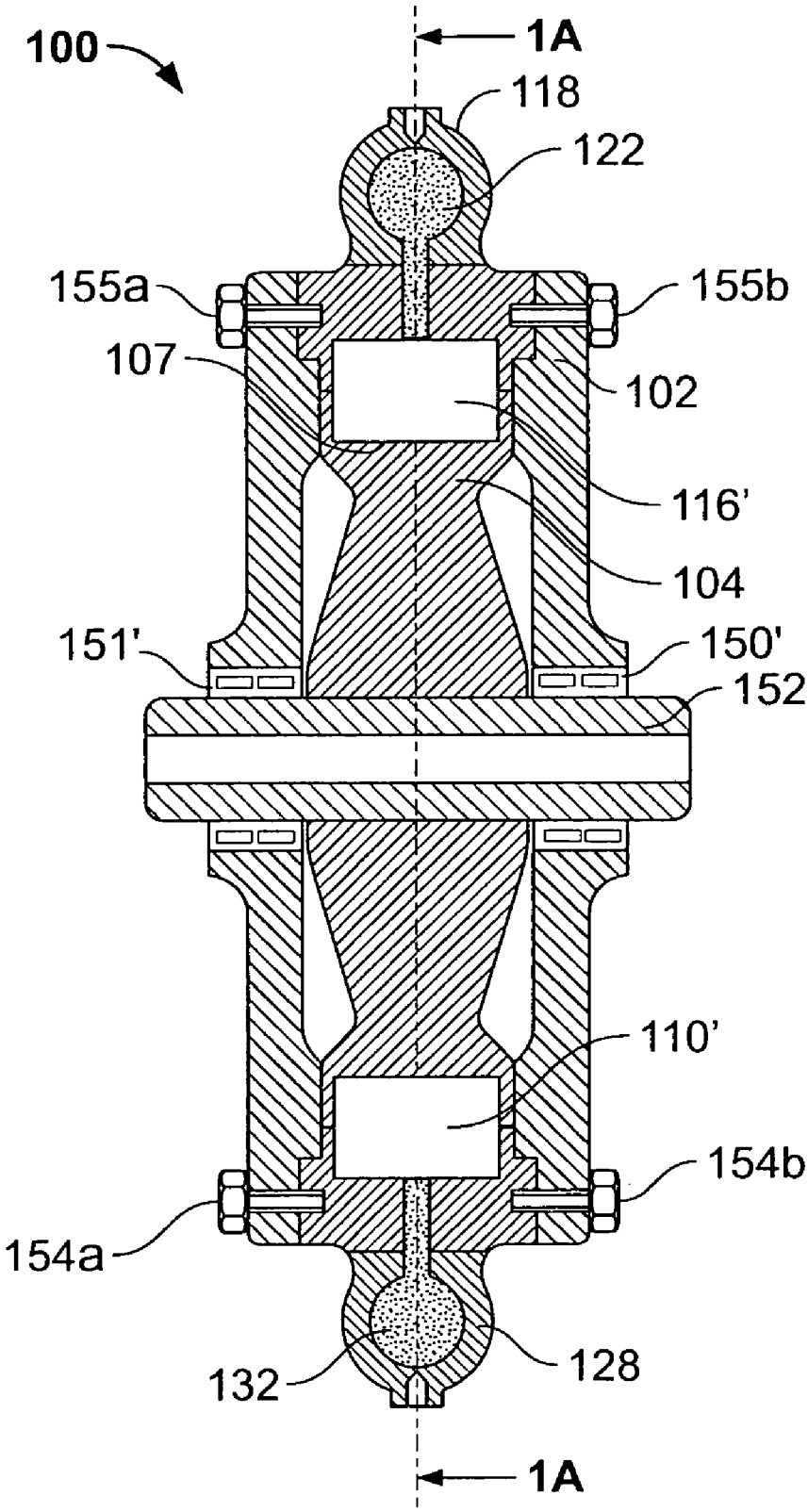
FIG. 1C is a partial cross-sectional front view of the exemplary rotary engine of FIG. 1A, in accordance with an embodiment of the invention.

In accordance with another embodiment of the invention, a rotary engine 100 may comprise a housing 102 having at least one inlet valve (120, 130) and a plurality of outlet valves (138, . . . , 148). The plurality of outlet valves (138, . . . , 148) may be disposed on the peripheral surface of the housing 102. The rotary engine 100 may also comprise at least one chamber (118, 128) coupled to the housing 102 and to the at least one inlet valve. The at least one chamber (118, 128) may be adapted for storing a pressurized substance (122, 132). The rotary engine 100 may further comprise a generally cylindrical driveshaft 152 extending through the housing 102, and a rotor 104 that is rotationally mounted in the housing 102 and on the driveshaft 152. The rotor 104 may comprise a plurality of recessed portions 107 situated radially along the peripheral surface of the rotor 104. The plurality of recessed portions 107 may be used for receiving a plurality of rolls (e.g., rolls 110' . . . 116', as illustrated in FIG. 1C). The plurality of rolls may be rotationally engaged between an inner surface of the housing 102 and the peripheral surface of the rotor 104. Each of the plurality of rolls may remain in a corresponding one of the plurality of recessed portions 107 while the rotor 104 rotates within the housing 102. The at least one inlet valve (120, 130) may be disposed between the housing 102 and the at least one chamber (118, 128) so that the pressurized substance (122, 132) may be released inside the housing 104, thereby rotationally engaging at least a portion of the plurality of rolls, and thereby causing rotation of the rotor 104. The plurality of rolls may comprise a plurality of metal cylinders and/or a plurality of metal shortened cones.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A rotary engine, comprising in combination:

a housing having at least one inlet valve and at least one outlet valve;

at least one chamber coupled to said housing and to said at least one inlet valve;

a generally cylindrical driveshaft extending through said housing; and a rotor that is rotationally mounted in said housing on said driveshaft, wherein said rotor comprises a plurality of recessed portions situated radially along a peripheral surface of said rotor, said plurality of recessed portions for receiving a plurality of spheres, said plurality of spheres being rotationally engaged between an inner surface of said housing and the peripheral surface of said rotor, and wherein each of said plurality of spheres remains in a corresponding one of said plurality of recessed portions while said rotor rotates within said housing, wherein said housing comprises a servicing knob, wherein said servicing knob is threaded onto said housing, wherein when said servicing knob is removed, a resulting opening in said housing is used to remove one or more of said plurality of spheres for servicing.

2. The rotary engine according to claim 1, wherein said at least one chamber is removably mounted to said housing.

3. The rotary engine according to claim 1, wherein said at least one chamber is adapted for storing a pressurized substance.

4. The rotary engine according to claim 3, wherein said at least one inlet valve is disposed between said housing and said at least one chamber so that when said pressurized substance is released inside said housing, said pressurized substance rotationally engages at least a portion of said plurality of spheres, and thereby causing rotation of said rotor.

5. The rotary engine according to claim 3, wherein said substance comprises one of the following: gaseous substance and liquid.

6. The rotary engine according to claim 3, wherein said at least one chamber comprises at least one inlet valve for filling up said at least one chamber with said substance.

7. The rotary engine according to claim 1, wherein said rotor and said driveshaft are molded as a single element.

8. The rotary engine according to claim 1, wherein said driveshaft is insulated from the housing via one or both of the following: a plurality of ball-bearings and a plurality of roller-bearings.

9. The rotary engine according to claim 1, wherein said plurality of recessed portions are spaced at equal distances along said peripheral surface of said rotor.

10. The rotary engine according to claim 1, wherein said at least one outlet valve is disposed along a perimeter of said housing.

* * * * *